US008881917B1

(12) United States Patent
Sooknanan

(10) Patent No.: US 8,881,917 B1
(45) Date of Patent: Nov. 11, 2014

(54) SCAFFOLD TOOL REST

(76) Inventor: Vajai Sooknanan, Richmond Hill, NY (US)

( * ) Notice: Subject to any disclaimer, the term of this patent is extended or adjusted under 35 U.S.C. 154(b) by 115 days.

(21) Appl. No.: 13/536,217

(22) Filed: Jun. 28, 2012

(51) Int. Cl.
*A47F 7/00* (2006.01)

(52) U.S. Cl.
USPC ..... 211/70.6; 211/133.3; 248/218.4; 248/230.6; 248/238

(58) Field of Classification Search
USPC ..... 211/60.01, 69, 69.1, 69.4, 70.1, 70.6, 211/70.7, 70.8, 71.01, 72, 74, 75, 86.01, 211/88.01, 888.03, 90.01, 133.3; 248/238, 248/218.4, 219.4, 226.11, 227.3, 230.1, 248/230.6, 231.71, 235, 245; 182/121
See application file for complete search history.

(56) References Cited

U.S. PATENT DOCUMENTS

| | | | | | |
|---|---|---|---|---|---|
| 567,755 | A * | 9/1896 | Stillman | 248/238 |
| 1,352,914 | A * | 9/1920 | Plasclascovitie | 182/121 |
| 2,323,425 | A * | 7/1943 | Seiler | 182/200 |
| 2,606,079 | A * | 8/1952 | White | 182/121 |
| 3,182,749 | A * | 5/1965 | Girardello | 182/120 |
| 3,734,236 | A * | 5/1973 | Houtler | 182/121 |
| 3,738,601 | A * | 6/1973 | Gehringer | 248/210 |
| 5,120,013 | A | 6/1992 | Sweeney | |
| 5,547,080 | A | 8/1996 | Klimas | |
| 5,740,883 | A | 4/1998 | Trank | |
| 6,000,497 | A * | 12/1999 | Kain et al. | 182/129 |
| 6,098,749 | A | 8/2000 | Enochs | |
| 6,131,699 | A * | 10/2000 | Leak, Jr. | 182/129 |
| 6,467,744 | B1 * | 10/2002 | Calin | 248/214 |
| 6,837,383 | B1 * | 1/2005 | McElhaney, Jr. | 211/70.6 |
| D516,227 | S | 2/2006 | Price | |
| 2001/0007343 | A1 | 7/2001 | McElhaney, Jr. | |
| 2004/0055979 | A1 * | 3/2004 | Fabregas | 211/70.6 |
| 2006/0169537 | A1 | 8/2006 | Enochs | |

* cited by examiner

*Primary Examiner* — Korie H Chan
(74) *Attorney, Agent, or Firm* — Robert C. Montgomery; Montgomery Patent & Design

(57) ABSTRACT

Disclosed is tool rest for holding tools, materials, and supplies on scaffolding. The tool rest can attach to either the short end or the long side of scaffolding. The tool rest includes a tool tray that is defined by a relatively large, flat horizontal floor surrounded by raised perimeter curb sections. A shelf assembly extends horizontally from one (1) curb section. The shelf assembly includes a flat surface having multiple openings for receiving cup holders or tools. The tool rest clamps to scaffolding posts and includes a mounting assembly having an attachment bracket and at least one (1) angled brace that increases the tool tray loading capacity. The tool rest is detachable and is designed to not interfere with the functionality or safety of the scaffolding.

5 Claims, 4 Drawing Sheets

SCAFFOLD TOOL REST

RELATED APPLICATIONS

There are currently no co-pending applications.

FIELD OF THE INVENTION

The presently disclosed subject matter is directed tool rests for use on scaffolding. More particularly, the present invention relates to detachable tool rests for holding tools, materials, and supplies on scaffolding.

BACKGROUND OF THE INVENTION

Whenever large structures such as buildings are under construction or being repaired it is necessary to provide workers with ready access to all areas of those structures. From ancient Egypt to today such access has been provided by scaffolding. A scaffold is a temporary structure placed around a large structure to support people, tools, and materials and to provide access to work areas.

Scaffolding takes at least two (2) forms. A scaffold can be constructed in situ. After use such scaffolds are torn down. Such scaffolding provides great flexibility in that the scaffold can be made very large, very tall, and/or customized to particular applications. However, some jobs such as painting do not require such extreme flexibility. In those applications the use of Baker-style scaffolding is common. A Baker-style scaffold is a rather small, pre-made scaffold that is assembled when required and moved about. When work is being performed a Baker-style scaffold is rolled about on integral wheels or simply picked up and moved to other locations as need. When not needed a Baker-style scaffold is disassembled and moved to another site or stored. Because of their ease of assembly and mobility, Baker-style scaffolds are widely used in painting, sheet rocking, electrical installation and maintenance.

More often than not, workers on scaffolding are required to use tools and materials to complete their tasks. However, since Baker-style scaffolding is relatively small, there is often no suitable location to place tools, materials, and supplies other than on the scaffolding floor. This creates several problems. First, when a tool or material is needed it is on the floor of the scaffolding and out of reach, which necessitates stopping work to retrieve. Second, locating items on the floor creates a tripping hazard which can be particularly dangerous at elevated work locations. Additionally, such tools, supplies, and materials can easily be kicked over the side of the scaffolding where they can fall on workers who may be working below. This can, and has resulted in horrific injuries.

While they have proven to be very useful, Baker-style scaffolding is often assembled from pipes, rods, or beams that fit together to form a relatively small skeleton structure. That structure tends to limit what can be used with the scaffold.

Accordingly, there exists a need for a means by which tools, supplies, materials and other items can be retained on Baker-style scaffolding.

SUMMARY OF THE INVENTION

The principles of the present invention provide for a scaffold tool rest that is suitable for use with Baker-style scaffolds.

A scaffold tool rest that is in accord with the present invention includes a substantially flat rectangular floor having a first long edge, a second long edge, a first short edge, and a second short edge. Raised curb section along those edges to provide a tool space. A shelf extension extends outward from and runs along a long curb section. The shelf extension includes a flat surface having multiple shelf apertures. The scaffold tool rest further includes means for attaching the scaffold tool rest to a scaffold.

The scaffold tool rest further includes a cup holder that is dimensioned to fit into a first of the multiple shelf apertures. Other shelf apertures can be dimensioned to hold tools and other equipment.

Attachment of the scaffold tool rest to a scaffold is beneficially performed using a first bracket assembly and a second bracket assembly that are configured to attach to scaffolding posts. The first bracket assembly includes at least one (1) elongated first bracket member that is attached to and extends down vertically from a long curb section. The first bracket member has a first mating surface that is dimensioned to mate with a scaffold post. Usually the first mating surface is a partial cylinder. The first bracket assembly also includes an upper pair of mounting ears and a lower pair of mounting ears. Each mounting ear extends outward from the first bracket member, and each mounting ear includes a pin aperture. The pin apertures of pairs of mounting ears align along centerlines. The scaffold tool rest is dimensioned to be retained on scaffold posts by placing the first mating surface against a scaffold post and inserting a first locking pin through the apertures of the upper pair of mounting ears and a second locking pin through the apertures of the lower pair of mounting ears. The scaffold tool rest further includes a first brace member attached to the floor that diagonally extends downward.

According to another embodiment, the present invention takes the form of a scaffold short tool rest. The scaffold short tool rest has a substantially flat rectangular floor having first, second, third, and fourth edges. Raised curb sections extend along those edges to define a tool space. A shelf extension extends outward from and runs along a curb section. The scaffold short tool rest further includes a means for attaching the scaffold tool rest to horizontal cross-members of a scaffold.

The means for attaching beneficially comprises a first cross-member bracket that is attached to a first curb section and a brace member having a second cross-member bracket on one (1) end and which is attached to the floor at the other end. The first cross-member bracket is designed to retain the scaffold short tool rest to a first horizontal cross-member by being placed over the first horizontal cross-member. The brace member diagonally extends from the floor to end in the second cross-member bracket, which is designed to mate with a second horizontal cross-member by being placed over the second horizontal cross-member. The first mating surface and the second mating surface will often define partial cylindrical surfaces.

The shelf extension of the scaffold short tool rest will beneficially include multiple shelf apertures. At least one (1) of the shelf apertures will beneficially be dimensioned to receive a cup holder while another will be dimensioned to receive a tool.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
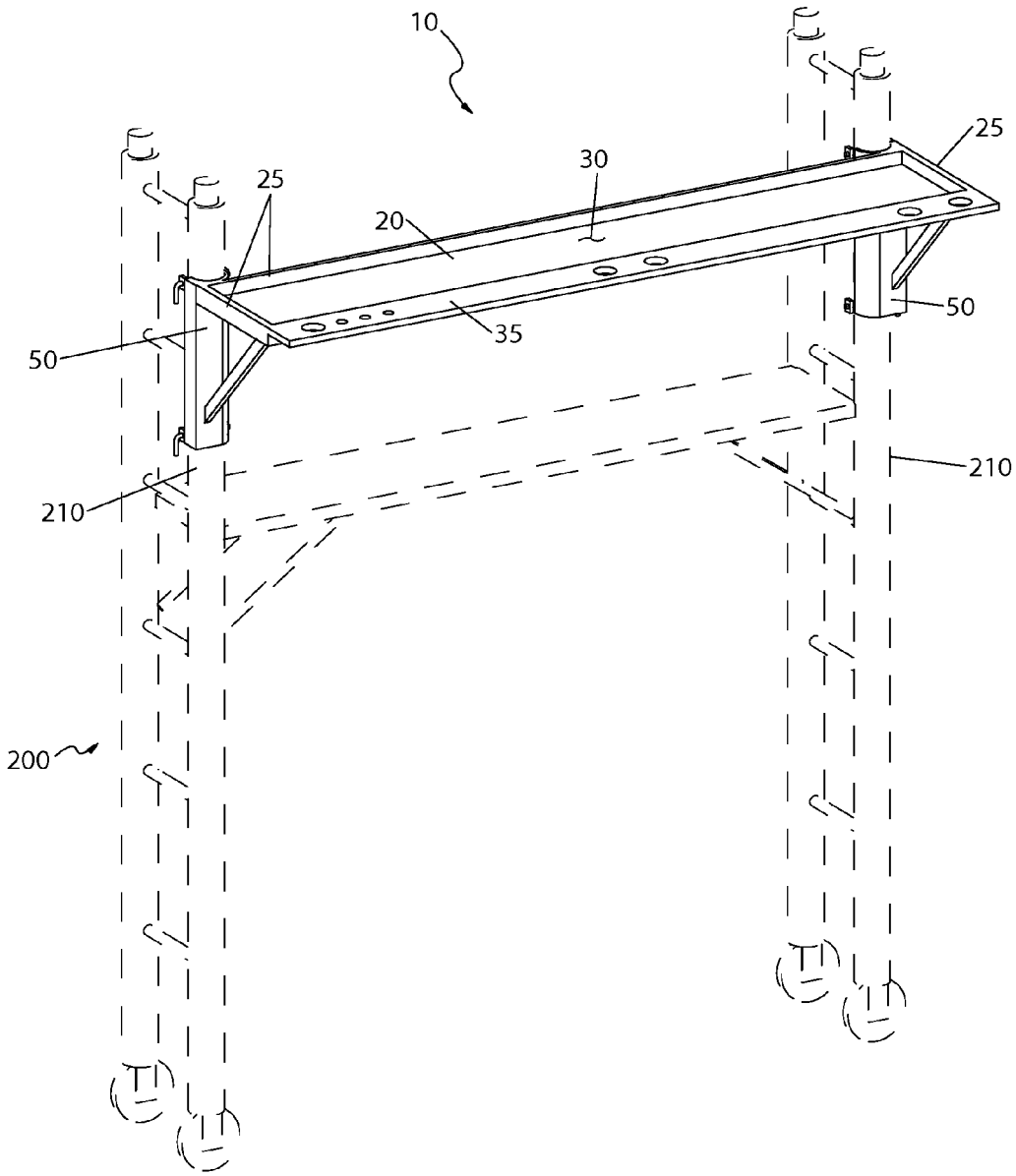
FIG. 1 is an environmental view of a scaffold tool rest 10 according to a preferred embodiment of the present invention.

10 scaffold tool rest
20 floor
25 curb section
30 tool space
35 shelf extension
37 shelf aperture
40 cup holder
50 mounting bracket assembly
52 bracket member
54 mounting ear
56 pin aperture
58 locking pin
60 brace member
100 short-side scaffold tool rest
120 alternative floor
125 alternative curb section
135 alternative shelf
150 first cross-member bracket
152 first slot
160 alternative brace member
170 second cross-member bracket
172 second slot
200 scaffolding
210 scaffold post
220 scaffold cross-member

DETAILED DESCRIPTION OF THE PREFERRED EMBODIMENT

Figure 2:
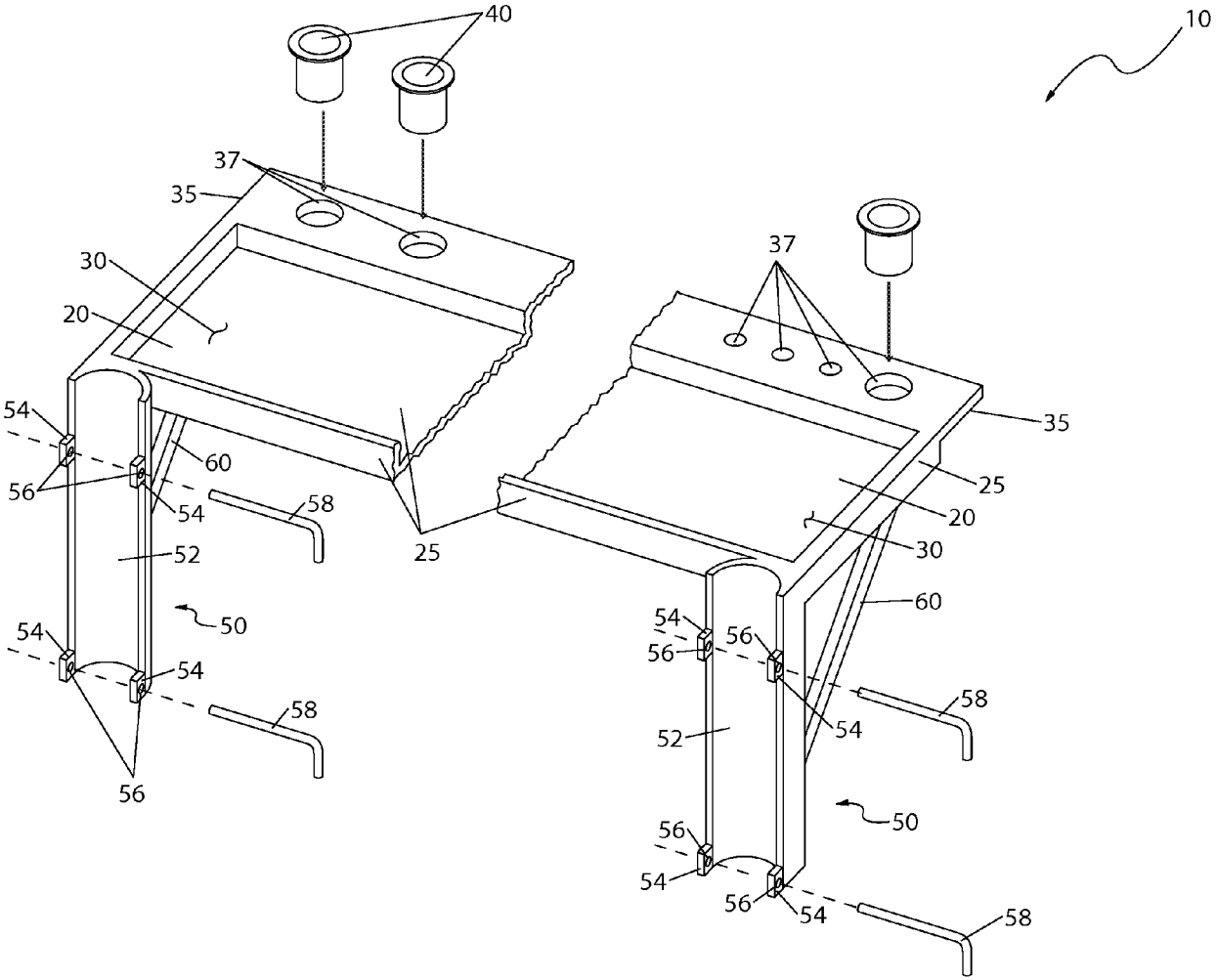
FIG. 2 is a close-up view of the scaffold tool rest 10 shown in FIG. 1.
Figure 3A:
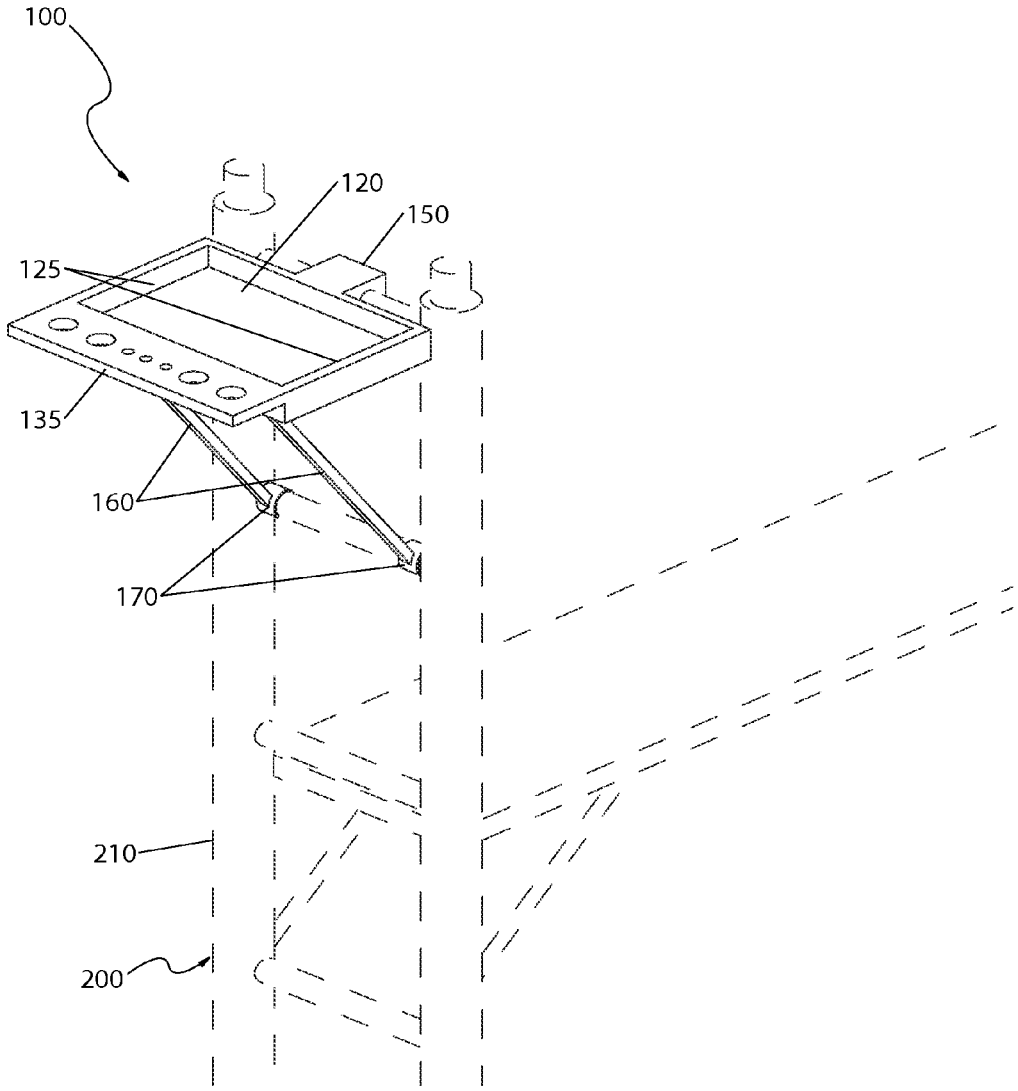
FIG. 3*a* is an environmental view of a short-side scaffold tool rest 100 according to an alternative embodiment of the present invention; and, FIG. 3*b* is a close-up view of the short-side scaffold tool rest 100 shown in FIG. 3*a*.
Figure 3B:
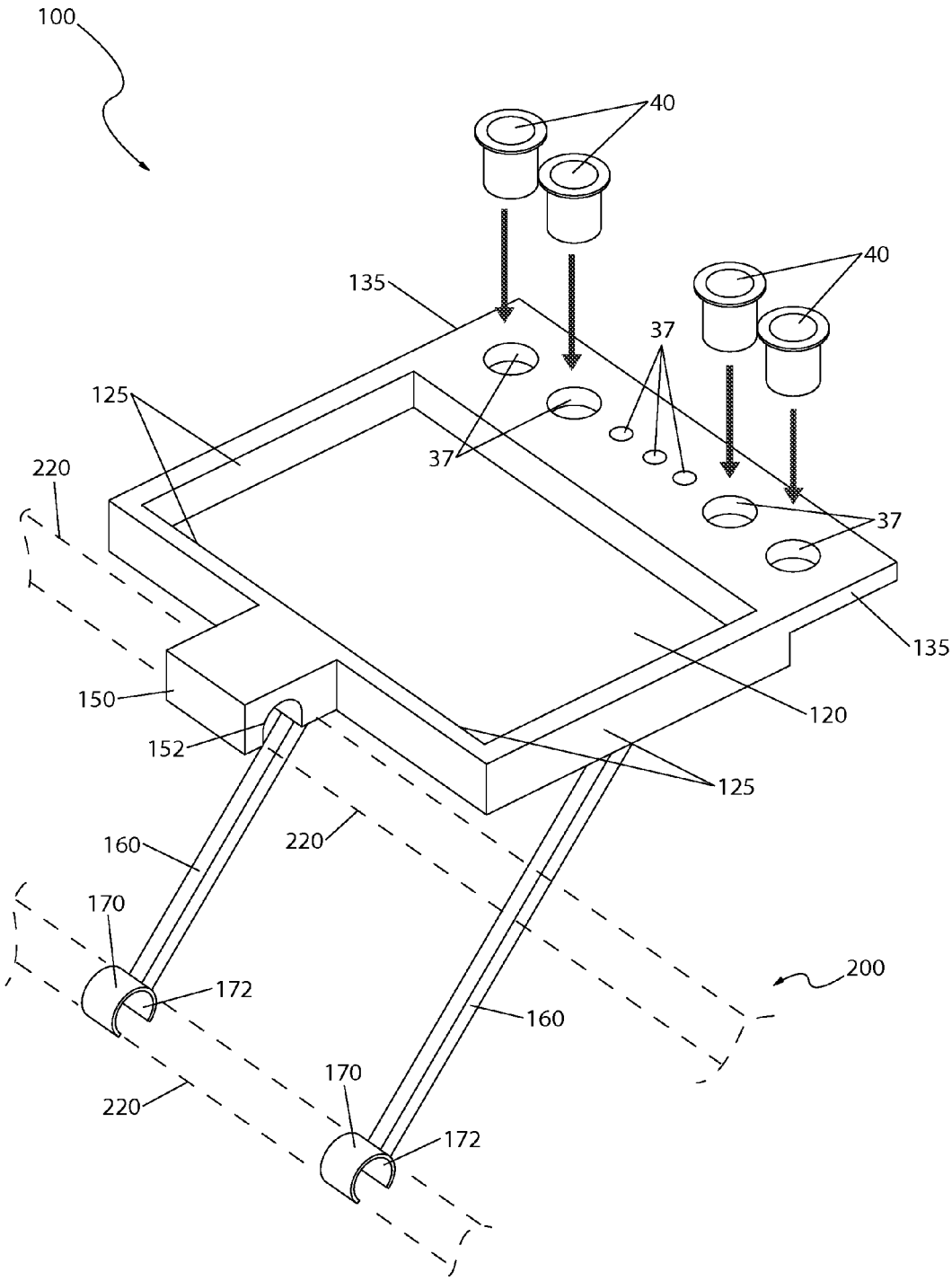

The best mode for carrying out the invention is presented in terms of its preferred embodiment, FIGS. 1 and 2, while an alternative embodiment is shown in FIGS. 3*a* and 3*b*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Referring now to FIG. 1, an environmental view of a scaffold tool rest 10 that is in accord with the present invention, the scaffold tool rest 10 provides a stable horizontal surface on scaffolding 200. That surface can hold a plurality of tools as well as materials and supplies. The scaffold tool rest 10 forms a removable tray structure attached along the long side of the scaffolding 200. The scaffold tool rest 10 is attached to scaffold posts 210 using locking pins 58 (shown in FIG. 2).

The scaffold tool rest 10 includes a relatively large, substantially flat floor 20 that is surrounded by upwardly protruding curb sections 25 which extend along the edges of the floor. There are four (4) curb sections: two (2) long and two (2) short. The curb sections 25 help retain tools and materials within a readily accessible tool space 30 defined by the floor 20 and the curb sections 25. An additional shelf extension 35 extends outward from the distal long curb section of the scaffold tool rest 10. As best shown in FIG. 2, the shelf extension 35 includes multiple shelf apertures 37 of various dimensions. The shelf apertures 37 are beneficially dimensioned to receive cup holders 40, a variety of tools, and other items.

Referring again to FIG. 1, the scaffold tool rest 10 is designed so that it does not interfere with the functionality or safety of the scaffolding 200 and such that it can easily be removed from the scaffolding 200. The scaffold tool rest 10 beneficially also serves as a safety guard rail to reduce the possibility of a fall. The scaffold tool rest 10 is illustrated being used on a Baker-style scaffold system; however, it should be understood that the scaffold tool rest 10 might be modified to allow use with different scaffold systems manufactured by various other suppliers. Thus the present invention is limited by the particular scaffold it is used with.

FIG. 2 shows a close-up view of the scaffold tool rest 10. Shown is the floor 20, a plurality of the curb sections 25 located around the scaffold tool rest 10, the shelf extension 35, two (2) mounting bracket assemblies 50, and a plurality of locking pins 58. As previously noted the floor 20 and the curb sections 25 define a tool space 30. The tool space 30 beneficially is a relatively large closed-in rectangular area. The tool space 30 enables controlled placement and/or storage of tools, equipment, and materials necessary to complete a project using the scaffolding 200.

Still referring to FIG. 2, the shelf extension 35 is a horizontally protruding surface formed by or affixed to an outer edge of curb sections 25. The shelf extension 35 includes the shelf apertures 37, which are beneficially formed or machined through the shelf extension 35. It should be understood that the shelf apertures 37 may comprise a variety of different diameters and shapes so as to act as receptacles for cup holders 40, screwdrivers, hammers, electric tools, and the like. The cup holders 40 are preferably used to retain various beverages; however, the cup holders 40 may also be utilized to hold miscellaneous items such as hardware, scaffolding fasteners, and the like.

As described with reference to FIG. 1, the scaffold tool rest 10 is designed to attach to vertical scaffold posts 210 of the scaffolding 200. Referring now to both FIGS. 1 and 2, attachment is accomplished using at least two (2) integrally affixed mounting bracket assemblies 50. It should be understood that the actual number and locations of the mounting bracket assemblies 50 depends on the particular size and configuration of the scaffolding 200 and the arrangement of its scaffold posts 210.

The mounting bracket assemblies 50 are beneficially positioned at and are attached to outer corners of a proximal curb section 25. Each mounting bracket assembly 50 includes a half-cylinder-shaped bracket member 52 that extends downward from the proximal curb section 25 approximately two (2) feet. The bracket members 52 form a partial inner cylindrical shape that matches the outer cylindrical shape of the scaffold posts 210. Of course if the scaffold posts 210 have different shapes the bracket members 52 will be modified to match that shape.

Each mounting bracket assembly 50 further includes a brace member 60 and four (4) integral mounting ears 54 having pin apertures 56 that are formed or machined there through. Each brace member 60 is affixed at one end to a lower rear section of a bracket member 52 and, extending diagonally upward and outward, is affixed at the other end to the bottom of the floor 20. The brace members 60 strengthen the scaffold tool rest 10 and buttress the floor 20.

Each bracket member 52 includes outwardly extending upper pair and a lower pairs of mounting ears 54. The pin apertures 56 of each pair of mounting ears 54 align along horizontal centerlines. In use, the bracket members 52 are positioned against scaffold posts 210 and are secured in place by inserting respective locking pins 58 through pairs of pin apertures 56. In practice the scaffold posts 210 have or would be modified to have apertures that align with the pin apertures 56 when the scaffold tool rest 10 is mounted to the scaffolding 200. The locking pins 58 are envisioned as being commercially available quick disconnect pins that are commonly used in industry.

The floor 20, curb sections 25, shelf extension 35, and mounting bracket assemblies 50 are preferably comprised of a lightweight metal such as aluminum; however, other rugged weather-resistant materials such as plated or painted steel, stainless steel, composite plastics, and the like may also be used.

An alternative embodiment short-side scaffold tool rest 100 is shown in FIGS. 3*a* and 3*b*. The short-side scaffold tool rest 100 is a "shortened" version that is attachable to scaffold cross-members 220 located along the ends of the scaffolding 200. The short-side scaffold tool rest 100 provides similar features and functionality as the previously described preferred embodiment scaffold tool rest 10.

The short-side scaffold tool rest 100 has a length that corresponds to the ends of the scaffolding 200. To that end the short-side scaffold tool rest 100 has an alternative floor 120, alternative curb sections 125, and an alternative shelf 135, all of which are shorter than corresponding members in the scaffold tool rest 10. As best shown in FIG. 3*b*, the short-side scaffold tool rest 100 has an integral first cross-member bracket 150 on an alternative curb section 125 and a pair of second cross-member brackets 170 at the ends of alternative brace members 160.

The first cross-member bracket 150 has a first slot 152 while the second cross-member brackets 170 have second slots 172. Those slots are shaped to mate with and entrap scaffold cross-member 220. The first cross-member bracket 150 is a generally rectangular protrusion that extends from the middle of an alternative curb section 125. The first slot 152 is formed with, or machined into, the bottom of the alternative curb section 125 to provide a profile that mates and entraps an upper scaffold cross-member 220. The alternative brace members 160, which provide a similar supporting function as the brace members 60, are affixed to the bottom of the alternative floor 120 and extend diagonally downwardly to respective second cross-member brackets 170. The alternative brace members 160 are affixed to the second cross-member brackets 170 in such a manner that the second slots 172 of the second cross-member brackets 170 align along a common centerline to receive a scaffold cross-member 220. The slots 152, 172 comprise half-cylinder-shaped indentations that mate with horizontal scaffold cross-members 220 so as to be securely held.

The features and positioning of the short-side scaffold tool rest 100 enable it to be used on a particular scaffolding 200. Preferably the short-side scaffold tool rest 100 could be used on scaffolding 200 coincidentally with the preferred embodiment scaffold tool rest 10. Furthermore, a second on a particular scaffolding 200 might be mounted to an opposite end of the scaffolding 200.

It is envisioned that other styles and configurations of the present invention can be easily incorporated into the teachings of the present invention, only one particular configuration is shown and described for purposes of clarity and disclosure and not by way of limitation of scope.

The preferred embodiment of the present invention can be utilized by the common user in a simple and effortless manner with little or no training. After initial acquisition of the scaffold tool rest 10, it would be installed and utilized as indicated in FIG. 1.

The method of utilizing the scaffold tool rest 10 may be achieved by performing the following steps: procuring a model of the scaffold tool rest 10 having a desired length and number of mounting bracket assemblies 50 and which corresponds with the scaffolding 200 onto which the scaffold tool rest 10 is to be installed; inserting the mounting bracket assemblies 50 coincidentally upon corresponding scaffold posts 210; aligning the pin apertures 56 of the mounting ears 54 with pre-drilled apertures within the scaffold posts 210; inserting the locking pins 58 through the pin apertures 56 and the scaffold posts 210; using the tool space 30 to place tools and other equipment necessary to perform a project; using the shelf apertures 37 to securely position various tools such as screwdrivers, hammers, and the like; positioning cup holders 40 within other shelf apertures 37 to hold beverages while working on the scaffolding 200; removing the scaffold tool rest 10 upon completion of a project by removing the locking pins 58 from the pin apertures 56 and removing the scaffold tool rest 10 from the scaffold 200; and saving time and money due to quick access to needed tools, equipment, and refreshments while working on a project.

The method of installing and using the alternative short-side scaffold tool rest 100 may be achieved by performing the following additional steps: attaching the short-side scaffold tool rest 100 to scaffold cross-members 220 by coincidentally engaging the first slots 152 of the first cross-member bracket 150, and the two (2) second slots 172 of respective second cross-member brackets 170 onto the scaffold cross-members 220 along an end of the scaffolding 200; using the short-side scaffold tool rest 100 in a similar manner as the previously described preferred embodiment scaffold tool rest 10; removing the short-side scaffold tool rest 100 upon completion of a project by lifting the first cross-member bracket 150 and the second cross-member brackets 170 in an upward direction; and, removing the short-side scaffold tool rest 100 from the scaffolding 200.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A scaffold tool rest, comprising:

a substantially flat rectangular floor having a first long edge, a second long edge, a first short edge, and a second short edge;

a raised first long curb section along said first long edge;

a raised second long curb section along said second long edge;

a raised first short curb section along said first short edge;

a raised second short curb section along said second short edge;

a shelf extension extending outward from and running along said second long curb section, said shelf extension having multiple shelf apertures;

a first bracket assembly having a partial cylinder shaped first bracket member that extends downward from said first long curb section, said first bracket member configured to mate with a scaffold post;

a second bracket assembly having a partial cylinder shaped second bracket member that extends downward from said first long curb section, said second bracket member configured to mate with a scaffold post; wherein said first bracket assembly further includes an upper pair of mounting ears and a lower pair of mounting ears, wherein each mounting ear extends outwardly from said first bracket member, wherein each mounting ear includes a pin aperture, wherein pin apertures of said upper pair of mounting ears align along their centerlines, and wherein pin apertures of said lower pair of mounting ears align along their centerlines;

wherein said first long curb section, said second long curb section, said first short curb section, and said second short curb section define a tool space.

2. The tool rest according to claim 1, further including a cup holder dimensioned to fit into a first of said multiple shelf apertures.

3. The tool rest according to claim 1, wherein at least one shelf aperture of said multiple shelf apertures is dimensioned to receive a tool.

4. The tool rest according to claim 1, wherein said scaffold tool rest is dimensioned to be retained on scaffold posts by placing said first mating surface against a scaffold post and inserting a first locking pin through said apertures of said upper pair of mounting ears and a second locking pin through said apertures of said lower pair of mounting ears.

5. The tool rest according to claim 1, further including a first brace member affixed at a lower section of said first bracket member, said first brace member extending diagonally upward and outward, and said first brace member being affixed at an upper section to the floor.

* * * * *